US011549335B2

(12) United States Patent
Assiri et al.

(10) Patent No.: US 11,549,335 B2
(45) Date of Patent: Jan. 10, 2023

(54) DOWNHOLE CLEANING TOOLS AND METHODS FOR OPERATING THE SAME

(71) Applicant: Saudi Arabian Oil Company, Dhahran (SA)

(72) Inventors: Ali M. Assiri, Khobar (SA); Bandar S. Al-Malki, Dammam (SA); Ghassan A. Essa, Dammam (SA); Oscar David Bautista Sayago, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 111 days.

(21) Appl. No.: 17/116,478

(22) Filed: Dec. 9, 2020

(65) Prior Publication Data

US 2022/0178226 A1 Jun. 9, 2022

(51) Int. Cl.

| | |
|---|---|
| ***E21B 37/00*** | (2006.01) |
| ***E21B 33/12*** | (2006.01) |
| ***F04D 1/00*** | (2006.01) |
| ***F04D 29/043*** | (2006.01) |

(52) U.S. Cl.

CPC ..... *E21B 37/00* (2013.01); *E21B 33/12* (2013.01); *F04D 1/00* (2013.01); *F04D 29/043* (2013.01)

(58) Field of Classification Search

CPC ..... E21B 37/00; E21B 33/12; E21B 37/04; F04D 1/00; F04D 29/043

See application file for complete search history.

(56) References Cited

U.S. PATENT DOCUMENTS

| | | | | | |
|---|---|---|---|---|---|
| 1,510,669 | A * | 10/1924 | Halliday | E21B 37/08 | 166/241.1 |
| 4,519,456 | A * | 5/1985 | Cochran | E21B 33/1243 | 166/147 |
| 5,318,128 | A * | 6/1994 | Johnson | E21B 37/08 | 166/312 |
| 5,516,360 | A * | 5/1996 | Normandeau | E21B 43/38 | 96/217 |
| 5,836,394 | A * | 11/1998 | Blank | E21B 37/02 | 166/334.4 |
| 10,125,579 | B2 * | 11/2018 | Gao | E21B 43/02 | |

(Continued)

FOREIGN PATENT DOCUMENTS

| | | |
|---|---|---|
| EP | 0754836 A1 | 1/1997 |
| WO | 2008058540 A1 | 5/2008 |
| WO | 2018152752 A1 | 8/2018 |

OTHER PUBLICATIONS

International Search Report and Written Opinion dated Jul. 16, 2021 pertaining to International application No. PCT/US2021/031722 filed May 11, 2021, 14 pages.

*Primary Examiner* — Steven A MacDonald
(74) *Attorney, Agent, or Firm* — Dinsmore & Shohl LLP

(57) ABSTRACT

A downhole tool assembly includes a housing, the housing defining one or more formation jetting ports structurally configured to pass fluid outward from the downhole tool assembly, a downhole motor positioned at least partially within the housing, a centrifugal pump coupled to the downhole motor, the centrifugal pump including a shaft coupled to the downhole motor, and one or more blades extending outward from the shaft, and a filtration element in communication with the centrifugal pump, where the filtration element is structurally configured to separate particulate matter from fluid passing through the filtration element.

13 Claims, 5 Drawing Sheets

(56) References Cited

U.S. PATENT DOCUMENTS

| | | | | |
|---|---|---|---|---|
| 10,253,241 | B2 * | 4/2019 | Svoboda | E21B 37/00 |
| 10,669,829 | B2 * | 6/2020 | Liang | E21B 7/15 |
| 10,677,001 | B2 * | 6/2020 | Gamage | C09K 8/52 |
| 2008/0202762 | A1 * | 8/2008 | Grubb | E21B 43/38 166/371 |
| 2010/0258296 | A1 * | 10/2010 | Lynde | E21B 37/00 166/105.1 |
| 2012/0273278 | A1 * | 11/2012 | Zhu | E21B 27/00 175/206 |
| 2015/0226046 | A1 * | 8/2015 | Wolf | F04C 13/00 166/372 |
| 2017/0096876 | A1 * | 4/2017 | Flores Perez | E21B 43/24 |
| 2018/0328146 | A1 * | 11/2018 | Kartha | E21B 41/0078 |
| 2020/0325757 | A1 * | 10/2020 | Hassan | F04D 13/10 |

* cited by examiner

DOWNHOLE CLEANING TOOLS AND METHODS FOR OPERATING THE SAME

BACKGROUND

Field

The present disclosure relates to downhole cleaning tools and methods for operating the same.

Technical Background

Wellbores may be drilled into the ground to extract petroleum in the form of fluids and/or gases. During the drilling process, drilling fluid may be utilized to assist with the drilling of the wellbore. The drilling fluid may include fine particulate matter that invades ground surrounding the wellbore, thereby reducing the permeability of the ground surrounding the wellbore. The reduced permeability may negatively impact the productivity of the wellbore.

BRIEF SUMMARY

Accordingly, it is desirable to mitigate the reduced permeability of the ground surrounding the wellbore as the result of the invasion of the drilling fluid and/or as the result of other mechanisms that can result in reduced permeability of the ground surrounding the wellbore. Some configurations include passing fluid from the wellbore up to the surface and filtering and/or treating the fluid at the surface. However, passing fluid to the surface can be time consuming and costly, particularly in deep wellbores or offshore wellbores.

Embodiments of the present disclosure are generally directed to downhole tool assemblies that filter fluid in place within a wellbore. By filtering fluid in place within the wellbore, the time and cost associated with increasing the permeability of ground surrounding the wellbore may be reduced as compared to configurations in which the fluid is passed to the surface.

In one embodiment, a downhole tool assembly includes a housing, the housing defining one or more formation jetting ports structurally configured to pass fluid outward from the downhole tool assembly, a downhole motor positioned at least partially within the housing, a centrifugal pump coupled to the downhole motor, the centrifugal pump including a shaft coupled to the downhole motor, and one or more blades extending outward from the shaft, and a filtration element in communication with the centrifugal pump, where the filtration element is structurally configured to separate particulate matter from fluid passing through the filtration element.

In another embodiment, a downhole tool assembly including a housing including an inner sidewall defining an inner cavity, and an outer sidewall positioned outward of the inner sidewall where the inner sidewall and the outer sidewall define a fluid channel positioned between the inner sidewall and the outer sidewall, a downhole motor positioned at least partially within the inner cavity of the inner sidewall, and a centrifugal pump coupled to the downhole motor.

In yet another embodiment, a method for cleaning a wellbore includes drawing a fluid into a housing of a downhole tool assembly, the housing defining an inner cavity, passing the fluid to a centrifugal pump, the centrifugal pump including a shaft and one or more blades extending outward from the shaft, rotating the shaft and the one or more blades of the centrifugal pump, thereby drawing the fluid through the centrifugal pump, and passing the fluid from the centrifugal pump out a formation jetting port of the housing.

Additional features and advantages of the technology disclosed in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments of the present disclosure are directed to downhole tool assemblies that may be utilized to mitigate formation damage by "cleaning" wellbores. The downhole tool assemblies generally include a housing and a downhole motor. In some embodiments, a centrifugal pump is coupled to the downhole motor, and a filtration element is in communication with the centrifugal pump. The centrifugal pump and/or the filtration element may remove particulate matter from formation fluid drawn through the downhole tool assembly. By removing particulate matter from the formation fluid, the downhole tool assemblies may mitigate formation damage that may result from drilling processes. In some embodiments, the downhole tool assemblies may be operable to pass an acid wash or the like to the wellbore to mitigate formation damage. These and other embodiments will now be described with reference to the appended drawings.

Figure 1:
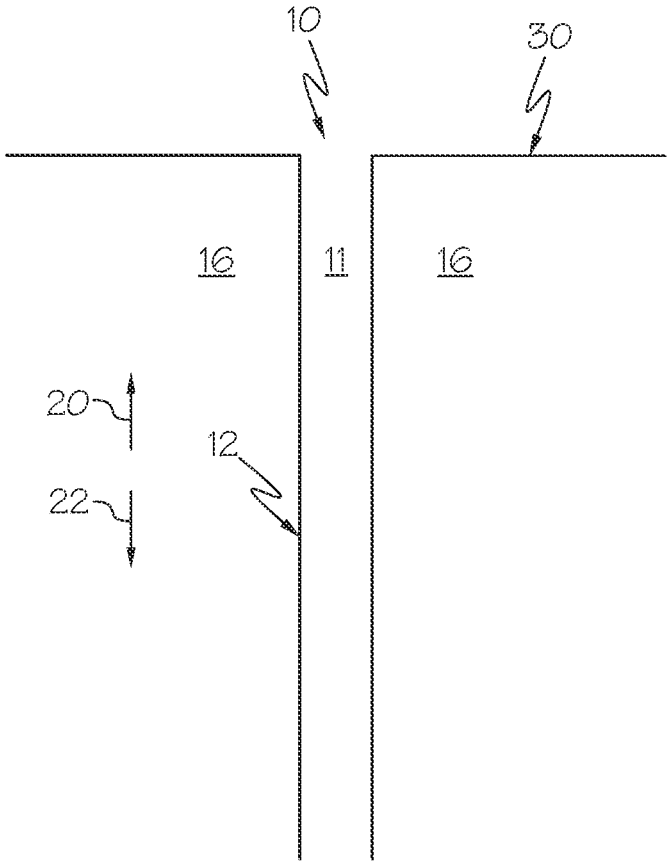
FIG. 1 schematically depicts a section view of a wellbore, according to one or more embodiments shown and described herein.

Now referring to FIG. 1, a section view of a wellbore 10 defining a well wall 12 is schematically depicted. The wellbore 10 generally extends from an opening 11 below a surface 30, which may be a ground surface (i.e., in land-based wellbores 10) or may be the floor of a body of water (i.e., in offshore wellbores 10). Gases and/or fluids, such as petroleum products, may be extracted through the wellbore 10. While in FIG. 1 the wellbore 10 is depicted as having a generally vertical orientation, it should be understood that this is merely illustrative, and wellbores 10 according to the present disclosure may extend in any suitable direction below the surface 30. For example, wellbores 10 may extend at least partially in a horizontal direction and/or may include portions that extend in the horizontal direction.

The wellbore 10 may be formed by a drill (e.g., a drill string), and drilling fluids (i.e., drilling mud) may be utilized to aid the drilling of the wellbore 10. The drilling fluid may cause formation damage in the wellbore 10, reducing the permeability of ground 16 surrounding the wellbore 10. For example, drilling fluid may include fine particles referred to as "fines" that may invade the surrounding ground 16. As the fines invade the surrounding ground 16, the permeability of the surrounding ground 16 generally decreases, thereby restricting the flow of fluid (e.g., formation fluid and/or reservoir fluid) from the surrounding ground 16 to the wellbore 10. Formation damage may also occur via other mechanisms, such as fines migration (e.g., the movement of naturally existing fine particles into the pore system of the surrounding ground 16) or phase trapping and blocking (e.g., the reduction in water saturation caused by the invasion of fluids from the wellbore 10 to the surrounding ground 16). Formation damage may also occur via glazing and mashing (e.g., damage to the well wall 12 by a drill bit or rotating drill string), perforation damage (e.g., damage associated with perforation gun charges fracturing rock into fine grains that degrade the permeability of the surrounding ground 16), and/or proppant crushing and embedment (e.g., damage associated with hydraulic fracturing). The restriction of the flow of fluid to the wellbore 10 may negatively impact the productivity of the wellbore 10, and accordingly it is desirable to reduce formation damage.

To reduce the formation damage (i.e., to increase the permeability of the surrounding ground 16), fluids from the surrounding ground 16 may be filtered to remove particulate matter. By filtering fluids from the surrounding ground 16, the permeability of the surrounding ground 16 may be increased, thereby reducing the formation damage and increasing the productivity of the wellbore 10.

Figure 2:
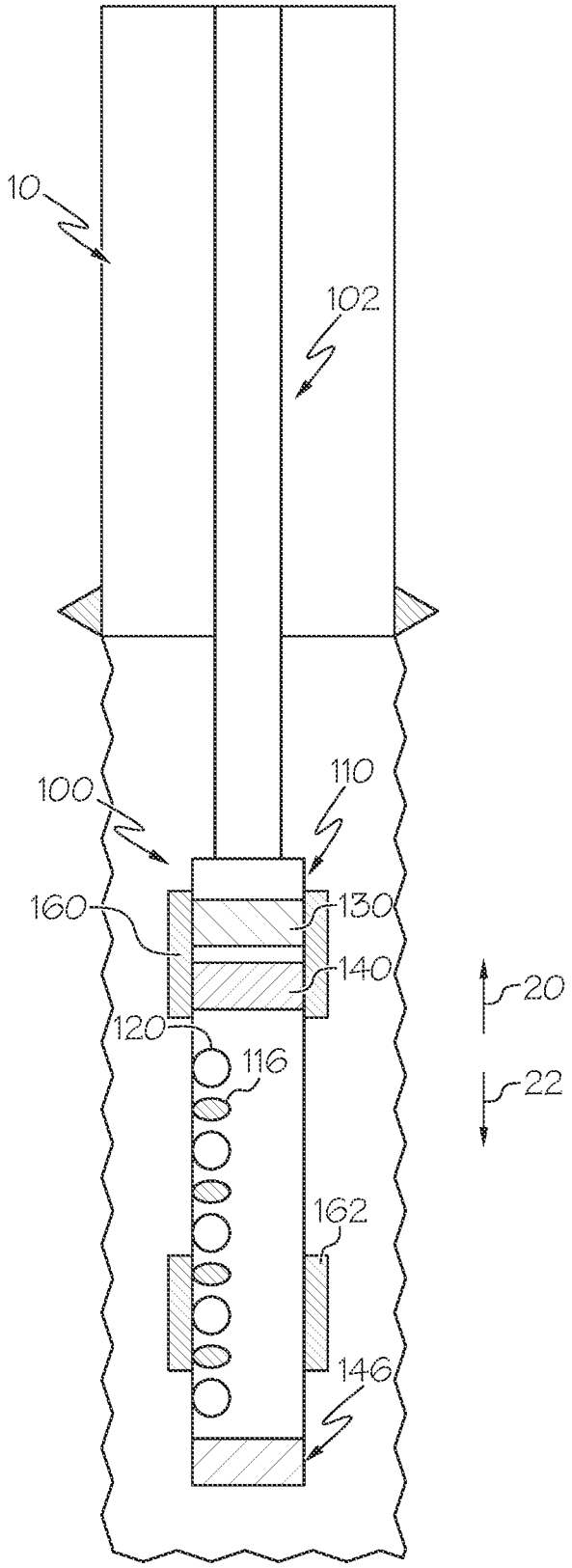
FIG. 2 schematically depicts a side view of a downhole tool assembly positioned in the wellbore of FIG. 1, according to one or more embodiments shown and described herein.

Referring to FIG. 2, a downhole tool assembly 100 is depicted within the wellbore 10. In embodiments, the downhole tool assembly 100 may be positioned on string 102 extending into the wellbore 10. While the embodiment depicted in FIG. 2 shows the string 102, it should be understood that this is merely an example, and the downhole tool assembly 100 may be positioned on any suitable device, such as a wireline, coil tubing, or may be part of a completion accessory. In embodiments, the downhole tool assembly 100 may be removable from the wellbore 10, or may be part of permanent downhole completion design.

The string 102 may extend between the downhole tool assembly 100 to the opening 11 (FIG. 1) of the wellbore 10. In some embodiments, the string 102 may be in fluid communication with the downhole tool assembly 100, such that fluids can be passed along the string 102 to the downhole tool assembly 100. As described in greater detail herein, solutions such as an acid wash, solvents, or the like may be passed along the string 102 to the downhole tool assembly 100 to the downhole tool assembly 100 to assist with treating the wellbore 10 (e.g., via matrix stimulation), in some embodiments.

In embodiments, the downhole tool assembly 100 generally includes a housing 110, a downhole motor 130 positioned at least partially within the housing 110, a centrifugal pump 140 coupled to the downhole motor 130, and a filtration element 146 in communication with the centrifugal pump 140. While the housing 110 is depicted as having a generally cylindrical shape and positioning of certain components are described herein in relation to "radial" and "circumferential" directions, it should be understood that this is merely an example, and the housing 110 may have any suitable shape. For example, in embodiments, the housing 110 may have a polygonal prism shape or the like.

In some embodiments, the housing 110 defines one or more circulation ports 120. Fluid surrounding the downhole tool assembly 100 may enter into the housing 110 through the one or more circulation ports 120. The housing 110, in some embodiments, includes one or more formation jetting ports 116 structurally configured to pass fluid outward from the downhole tool assembly 100. Filtered fluid from the downhole tool assembly 100 may be passed out of the housing 110 through the one or more formation jetting ports 116, as described in greater detail herein.

In some embodiments, the downhole tool assembly 100 may include one or more packer assemblies 160 engaged with an outer surface of the housing 110. For example, in the embodiment depicted in FIG. 2, the downhole tool assembly 100 includes an upstream packer assembly 160 and a downstream packer assembly 162. As referred to herein, the term "downstream" refers to the relative positioning of components of the downhole tool assembly 100 in a direction 22 extending away from the opening 11 (FIG. 1) of the wellbore 10. The term "upstream" refers to the relative positioning of components extending in a direction 20 toward the opening 11 (FIG. 1) of the wellbore 10 and is opposite the direction 22. While the directions 20, 22 are depicted as extending in the vertical direction, it should be understood that this is merely an example. In some embodiments, the upstream packer assembly 160 is positioned upstream of the one or more formation jetting ports 116 and/or the one or more circulation ports 120. In some embodiments, the downstream packer assembly 162 may be positioned downstream of some or all of the one or more formation jetting ports 116 and/or the one or more circulation ports 120.

In embodiments, the upstream packer assembly 160 and the downstream packer assembly 162 may engage the well wall 12 (FIG. 1) and the housing 110 of the downhole tool assembly 100. By engaging the well wall 12 (FIG. 1) and the housing 110, the upstream packer assembly 160 and/or the downstream packer assembly 162 may restrict the flow of fluid between the well wall 12 (FIG. 1) and the housing 110. As such, the upstream packer assembly 160 and/or the downstream packer assembly 162 may at least partially seal the one or more formation jetting ports 116 and/or the one or more circulation ports 120 from areas of the wellbore 10 spaced apart from the downhole tool assembly 100.

In embodiments, the downhole motor 130 is structurally configured to rotate the centrifugal pump 140. The downhole motor 130 may include any suitable motor for rotating a centrifugal pump 140 positioned in a wellbore 10, and may include, for example and without limitation, a hydraulic motor or the like. In embodiments, the downhole motor 130 may be selectively activated in any suitable manner, for example and without limitation, a drop ball or the like.

Figure 3A:
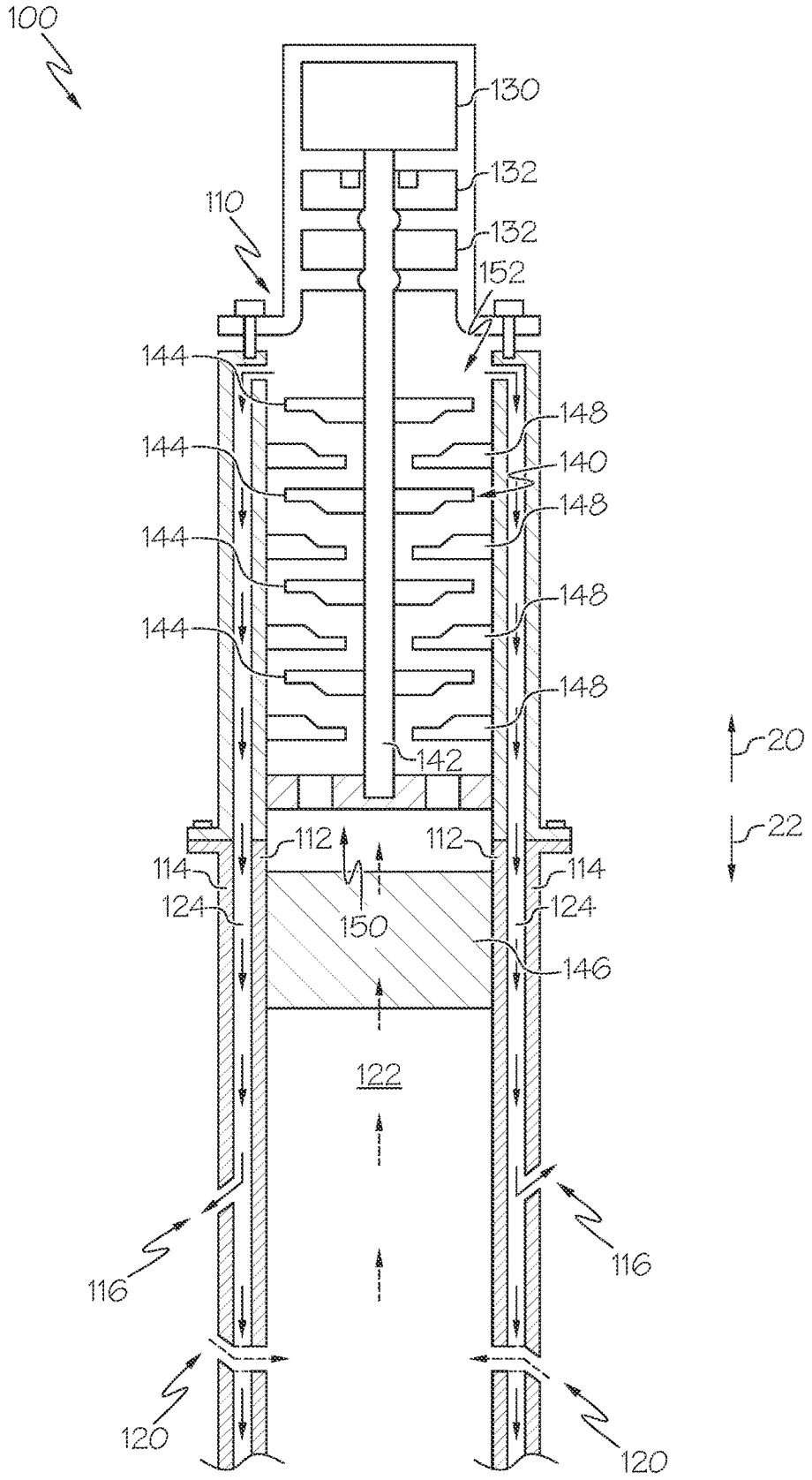
FIG. 3A schematically depicts a side section view of the downhole tool assembly of FIG. 2, according to one or more embodiments shown and described herein.

Referring to FIG. 3A, a section view of the downhole tool assembly 100 is schematically depicted. In some embodiments, the housing 110 includes an inner sidewall 112 and an outer sidewall 114. The inner sidewall 112, in embodiments, is positioned inward (e.g., in a radial direction) of the outer sidewall 114.

In embodiments, the housing 110 defines an inner cavity 122. The centrifugal pump 140 and the filtration element 146, and/or the downhole motor 130 are positioned at least partially within the inner cavity 122. In some embodiments, the inner sidewall 112 defines the inner cavity 122 and the inner cavity 122 is positioned inward of the inner sidewall 112 (e.g., in a radial direction).

In some embodiments, the inner sidewall 112 and the outer sidewall 114 define one or more fluid channels 124 positioned between the inner sidewall 112 and the outer sidewall 114. The one or more fluid channels 124, in some embodiments, are in communication with the inner cavity 122, such that fluid can flow from the inner cavity 122 to the one or more fluid channels 124. For example, in some embodiments, the centrifugal pump 140 may move fluid from the inner cavity 122 to the one or more fluid channels 124, as described in greater detail herein.

In embodiments, the housing 110 defines the one or more formation jetting ports 116. For example, in the embodiment depicted in FIG. 3A, the outer sidewall 114 defines the one or more formation jetting ports 116. Fluid may be passed, in some embodiments, from the inner cavity 122, through the one or more fluid channels 124, and out the one or more formation jetting ports 116. In some embodiments, fluid, such as an acid wash, can be passed to the one or more formation jetting ports 116 from the string 102 (FIG. 2).

Figure 3B:
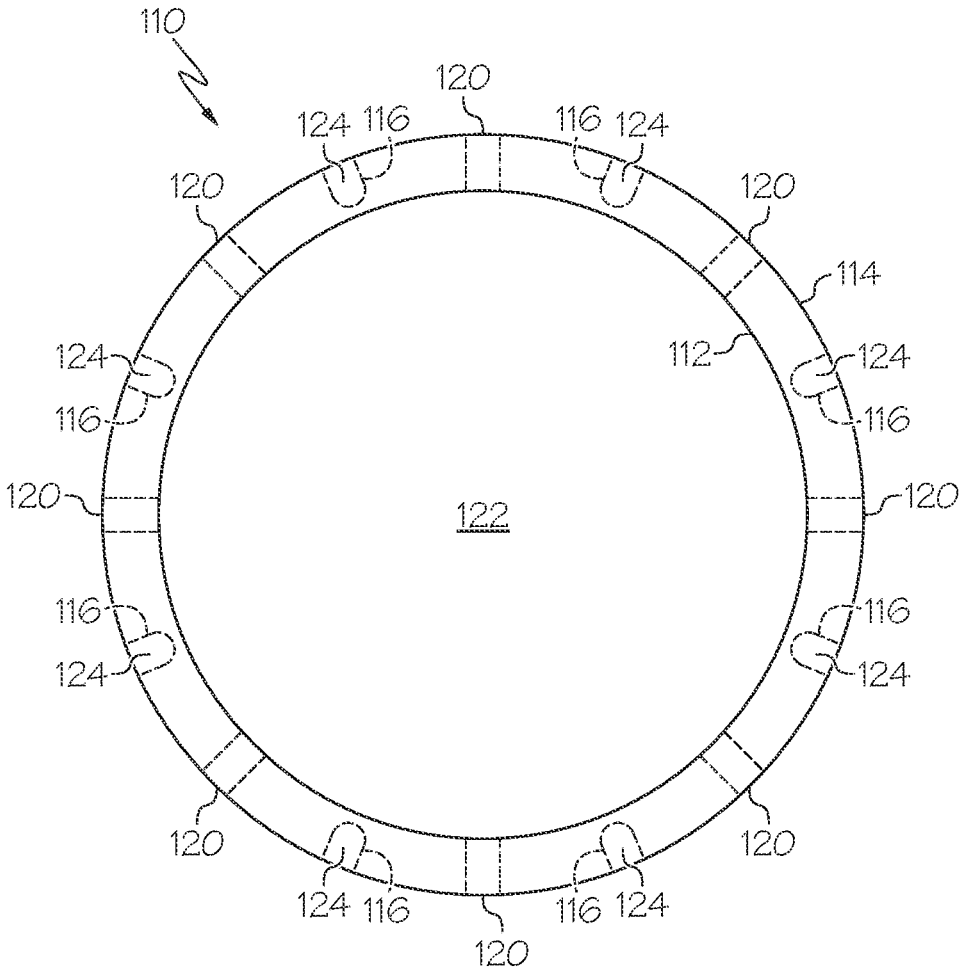
FIG. 3B schematically depicts a top section view of the downhole tool assembly of FIG. 3A, according to one or more embodiments shown and described herein.

Referring to FIGS. 3A and 3B, a top section view of the housing 110 is schematically depicted. In some embodiments, the one or more formation jetting ports 116 are spaced apart from the one or more circulation ports 120 in a circumferential direction. In embodiments, the one or more circulation ports 120 extend through the inner sidewall 112 and the outer sidewall 114, such that the one or more circulation ports 120 are in communication with the inner cavity 122 and fluid can be drawn from outside of the housing 110 to the inner cavity 122 through the one or more circulation ports 120.

In embodiments, the centrifugal pump 140 extends between a pump inlet 150 and a pump outlet 152. The centrifugal pump 140, in embodiments, includes a shaft 142 and one or more blades 144 extending outward from the shaft 142. In some embodiments, the centrifugal pump 140 may include one or more stators 148. In embodiments the one or more stators 148 may be positioned between the one or more blades 144. In the embodiment depicted in FIG. 3A, the one or more stators 148 extend inward from the inner sidewall 112.

The shaft 142, in embodiments, is coupled to the downhole motor 130. In some embodiments, the downhole tool assembly 100 may include one or more seals 132 positioned between the downhole motor 130 and the one or more blades 144 of the centrifugal pump 140. The one or more seals 132 may engage the shaft 142, restricting the flow of fluid from the centrifugal pump 140 to the downhole motor 130.

The downhole motor 130 may rotate the shaft 142, which thereby rotates the one or more blades 144. As the one or more blades 144 rotate, the one or more blades 144 may draw fluid through the centrifugal pump 140. For example, in some embodiments, the one or more blades 144 may be arranged helically along the shaft 142, such that the one or more blades 144 may draw fluid through the centrifugal pump 140 from the pump inlet 150 to the pump outlet 152.

Further, as the one or more blades 144 rotate, particulate matter within fluid passing through the centrifugal pump 140 from the pump inlet 150 to the pump outlet 152 may move radially outward as the result of centrifugal force applied to the fluid. In some embodiments, as the one or more blades 144 rotate, particulate matter may be passed to the one or more stators 148, which may retain at least a portion of the particulate matter, such that fluid exiting the pump outlet 152 has less particulate matter than fluid entering the pump inlet 150. In this way, the centrifugal pump 140 may act as a centrifugal separator, thereby assisting in removing particulate matter from fluid.

The filtration element 146, in embodiments, is in communication with the centrifugal pump 140, and is structurally configured to separate particulate matter from fluid passing through the filtration element 146. For example, fluid may pass to the filtration element 146 from the one or more circulation ports 120, through the filtration element 146, to the pump inlet 150. As the fluid passes through the filtration element 146, particulate matter in the fluid may be restricted from flowing through the filtration element 146, such that fluid passing from the filtration element 146 to the pump inlet 150 may have less particulate matter than fluid entering the filtration element 146. The filtration element 146, in embodiments, may include any suitable medium or mediums for restricting the flow of particulate matter.

Methods for operating the downhole tool assembly 100 to clean the wellbore 10 will now be described.

Figure 4:
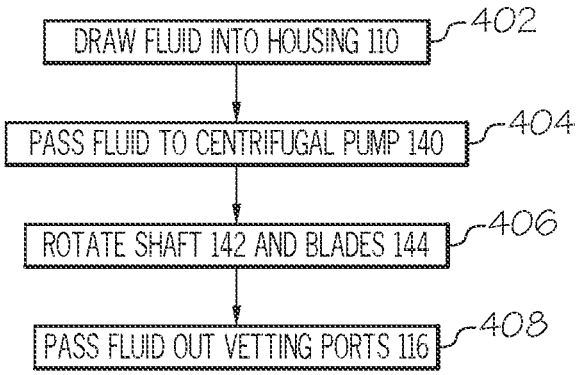
FIG. 4 depicts a flowchart of one method for operating the downhole tool assembly of FIG. 2, according to one or more embodiments shown and described herein.

Referring to FIGS. 3A and 4, an example flowchart for one method of operating the downhole tool assembly 100 is depicted. In a first block 402, fluid is drawn into the housing 110. For example and as described above, in embodiments, fluid (e.g., formation fluid and/or reservoir fluid) from the wellbore 10 (FIG. 1) and/or surrounding ground 16 (FIG. 1) may be drawn into the housing 110 through the one or more circulation ports 120.

In a second block 404, the fluid passed to the centrifugal pump 140. For example, as the fluid is drawn into the housing 110, the fluid may be passed through the inner cavity 122 to the centrifugal pump 140. In embodiments, the fluid may be drawn to the centrifugal pump 140 as a result of the movement of the centrifugal pump 140 (e.g., via the rotation of the one or more blades 144 of the centrifugal pump 140).

In embodiments in which the downhole tool assembly 100 includes the filtration element 146, the fluid may pass through the filtration element 146 as the fluid moves through the inner cavity 122 to the centrifugal pump 140. As described above, as the fluid moves through the filtration element 146, particulate matter within the fluid may be restricted from passing through the filtration element 146.

In a third block 406, the fluid is drawn through the centrifugal pump 140 via rotation of the one or more blades 144 of the centrifugal pump 140. As described above, the one or more blades 144 of the centrifugal pump 140 may be rotated as the downhole motor 130 rotates the shaft 142 of the centrifugal pump 140. As described above, as fluid passes through the centrifugal pump 140, particulate matter within the fluid may be separated from the fluid, for example as the result of centrifugal forces acting on the fluid. Accordingly, fluid passing out of the centrifugal pump 140 may generally have less particulate matter than fluid passing into the centrifugal pump 140.

In a fourth block 408, the fluid is passed from the centrifugal pump 140, out of the one or more formation jetting ports 116 of the housing 110. For example, in embodiments, fluid from the centrifugal pump 140 is passed through the one or more fluid channels 124 to the one or more formation jetting ports 116, and thereby out of the downhole tool assembly 100.

In this way, particulate matter within fluid (e.g., formation fluid and/or reservoir fluid) in the wellbore 10 (FIG. 1) can be removed, thereby reducing formation damage and increasing the permeability of surrounding ground 16 (FIG.

1). As noted above, in some embodiments, fluid, such as an acid wash, can also be passed to the one or more formation jetting ports 116 from the string 102 (FIG. 2) to reduce formation damage.

By reducing formation damage with the downhole tool assembly 100, the time and cost associated with reducing formation damage can be reduced as compared to conventional methods. For example, in some conventional configurations, formation fluid and/or reservoir fluid may be passed to the surface 30 (FIG. 1) for treatment/filtration, and may then be returned back to the wellbore. However, the time and energy required to move fluid from a downhole position within the wellbore 10 to the surface 30 (FIG. 1) may be significant, particularly in deep wellbores 10 and/or offshore wellbores 10. By treating/filtering formation fluid and/or reservoir fluid in place in the wellbore 10 with the downhole tool assembly 100, the time and cost associated with reducing formation damage can be reduced, thereby shortening the amount of time that the wellbore 10 is out of production.

Furthermore, because the formation fluid and/or reservoir fluid does not need to be passed to the surface 30 for treatment, the likelihood of spillage or leakage of fluid during transit to the surface 30 (FIG. 1) may be reduced as compared to conventional configurations.

Accordingly, it should now be understood that embodiments of the present disclosure are directed to downhole tool assemblies that may be utilized to mitigate formation damage by "cleaning" wellbores. The downhole tool assemblies generally include a housing and a downhole motor. In some embodiments, a centrifugal pump is coupled to the downhole motor, and a filtration element is in communication with the centrifugal pump. The centrifugal pump and/or the filtration element may remove particulate matter from formation fluid drawn through the downhole tool assembly. By removing particulate matter from the formation fluid, the downhole tool assemblies may mitigate formation damage, as may result from drilling processes.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus it is intended that the specification cover the modifications and variations of the various described embodiments provided such modifications and variations come within the scope of the appended claims and their equivalents.

It is noted that recitations herein of a component of the present disclosure being "structurally configured" in a particular way, to embody a particular property, or to function in a particular manner, are structural recitations, as opposed to recitations of intended use. More specifically, the references herein to the manner in which a component is "structurally configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A downhole tool assembly comprising:

a housing, the housing defining one or more formation jetting ports structurally configured to pass fluid outward from the downhole tool assembly;

a downhole motor positioned at least partially within the housing;

a centrifugal pump coupled to the downhole motor, the centrifugal pump comprising:

a shaft coupled to the downhole motor; and one or more blades extending outward from the shaft;

a filtration element in communication with the centrifugal pump, wherein the filtration element is structurally configured to separate particulate matter from fluid passing through the filtration element;

a packer assembly engaged with an outer surface of the housing, wherein the packer assembly is positioned upstream of the one or more formation jetting ports, and wherein the packer assembly is an upstream packer assembly; and a downstream packer assembly positioned downstream of the upstream packer assembly; and wherein:

the upstream packer assembly and the downstream packer assembly are each engaged with an outer surface of the housing; and the downstream packer assembly is positioned downstream of the one or more formation jetting ports.

2. The downhole tool assembly of claim 1, wherein the housing defines one or more circulation ports structurally configured to pass fluid into the housing.

3. The downhole tool assembly of claim 1, wherein the housing comprises an outer sidewall and an inner sidewall positioned inward of the outer sidewall.

4. The downhole tool assembly of claim 3, wherein the outer sidewall defines the one or more formation jetting ports.

5. The downhole tool assembly of claim 3, wherein the inner sidewall defines an inner cavity and wherein the centrifugal pump is positioned at least partially within the inner cavity.

6. The downhole tool assembly of claim 3, wherein the inner sidewall and the outer sidewall define a fluid channel positioned between the inner sidewall and the outer sidewall.

7. A downhole tool assembly comprising:

a housing comprising:

an inner sidewall defining an inner cavity; and an outer sidewall positioned outward of the inner sidewall wherein the inner sidewall and the outer sidewall define a fluid channel positioned between the inner sidewall and the outer sidewall, and the outer sidewall defines one or more formation jetting ports in communication with the fluid channel;

a downhole motor positioned at least partially within the inner cavity of the inner sidewall;

a centrifugal pump coupled to the downhole motor;

a packer assembly engaged with an outer surface of the housing, wherein the packer assembly is positioned upstream of the one or more formation jetting ports, and wherein the packer assembly is an upstream packer assembly; and a downstream packer assembly positioned downstream of the upstream packer assembly; and wherein:

the upstream packer assembly and the downstream packer assembly are each engaged with an outer surface of the housing; and the downstream packer assembly is positioned downstream of the one or more formation jetting ports.

8. The downhole tool assembly of claim 7, further comprising a filtration element in communication with the centrifugal pump, wherein the filtration element is structurally configured to separate particulate matter from fluid passing through the filtration element.

9. The downhole tool assembly of claim 7, wherein the fluid channel is in communication with the centrifugal pump.

10. A method for cleaning a wellbore, the method comprising:

drawing a fluid into a housing of a downhole tool assembly, the housing defining an inner cavity;

passing the fluid to a centrifugal pump, the centrifugal pump comprising a shaft and one or more blades extending outward from the shaft;

rotating the shaft and the one or more blades of the centrifugal pump, thereby drawing the fluid through the centrifugal pump; and passing the fluid from the centrifugal pump out a formation jetting port of the housing; and wherein:

the downhole tool assembly comprises a packer assembly engaged with an outer surface of the housing, wherein the packer assembly is positioned upstream of the formation jetting port, and wherein the packer assembly is an upstream packer assembly;

the downhole tool assembly comprises a downstream packer assembly positioned downstream of the upstream packer assembly;

the upstream packer assembly and the downstream packer assembly are each engaged with an outer surface of the housing; and the downstream packer assembly is positioned downstream of the formation jetting port.

11. The method of claim 10, wherein passing the fluid from the centrifugal pump out the formation jetting port comprises passing the fluid through a fluid channel positioned between an inner sidewall and an outer sidewall of the housing.

12. The method of claim 10, further comprising passing the fluid through a filtration element positioned at least partially within the inner cavity of the housing.

13. The method of claim 10, further comprising passing an acid wash out the formation jetting port of the housing.

* * * * *